United States Patent [19]

McNamee

[11] 4,450,664

[45] May 29, 1984

[54] TILE MOUNTING PROCESS AND PRODUCT

[76] Inventor: Patrick M. McNamee, 330 Guernsey Ave., Columbus, Ohio 43204

[21] Appl. No.: 394,522

[22] Filed: Jul. 2, 1982

[51] Int. Cl.[3] ..... E04F 13/18

[52] U.S. Cl. ..... 52/385; 52/384; 52/386; 52/511

[58] Field of Search ..... 52/747, 384, 385, 386, 52/390, 391, 392, 511; 411/508, 509, 510, 525, 526; 24/216, 217 R

[56] References Cited

U.S. PATENT DOCUMENTS

| | | | |
|---|---|---|---|
| 816,588 | 4/1906 | Moore . | |
| 1,149,141 | 8/1915 | Hook . | |
| 1,272,394 | 7/1918 | Devney . | |
| 2,538,396 | 1/1951 | Sutin | 24/216 |
| 2,623,311 | 12/1952 | Condon | 24/216 |
| 2,872,804 | 2/1959 | Baldanza | 52/384 |
| 2,946,612 | 7/1960 | Ahlgren | 411/510 |
| 2,968,995 | 1/1961 | Holden | 88/97 |
| 3,085,482 | 4/1963 | Yakubik | 52/390 |
| 3,427,095 | 2/1969 | Dykema et al. | 350/288 |
| 3,551,963 | 1/1971 | Mosher, Jr. et al. | 24/216 |
| 3,701,228 | 10/1972 | Taylor | 52/384 X |
| 3,916,756 | 11/1975 | Yoda | 24/217 R |
| 4,044,813 | 8/1977 | Emmons | 160/369 |
| 4,143,496 | 3/1979 | Destito | 52/385 X |
| 4,216,257 | 8/1980 | Schams et al. | 428/93 |

*Primary Examiner*—Alfred C. Perham

[57] ABSTRACT

Tiles are mounted on a substrate by an adhesive strip of material having a backing member mounted thereon. The strip is first adhered to the substrate and subsequently, a facing tile member is affixed to the backing member. The means for joining the tile and backing member comprise an aperture in the middle of the backing member to receive a prong which projects from the back face of the decorative tile. A raised geometric configuration on the front of the backing member engages the mirror image geometric shape on the back face of the tile to prevent rotational misalignment.

4 Claims, 8 Drawing Figures

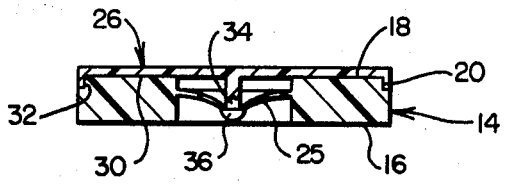
FIG. 3
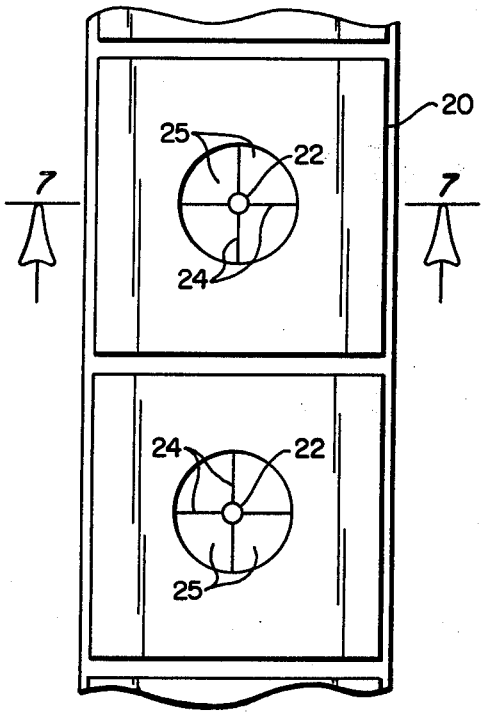
FIG. 4
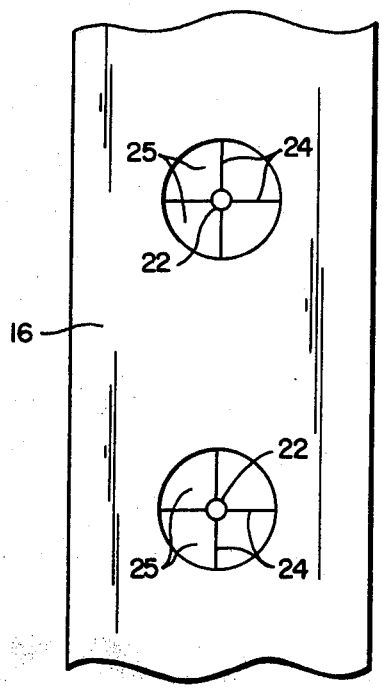
FIG. 5
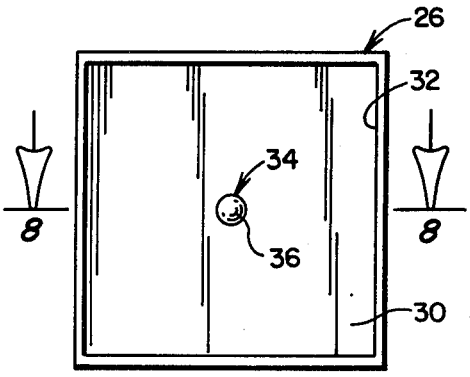
FIG. 6
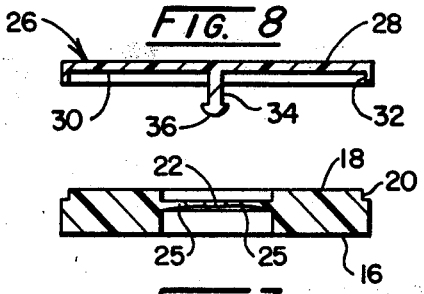
FIG. 8
FIG. 7

TILE MOUNTING PROCESS AND PRODUCT

FIELD OF THE INVENTION

This invention relates to a process for mounting decorative tiles on a substrate such as a wall as well as the product comprising the tile and support elements to be mounted.

BACKGROUND OF THE INVENTION

Tile setting is an ancient art running back thousands of years and it is essentially a manual operation wherein each tile is set by hand in a grout which will hold the tile in place. The grout is manually applied and the tiles are manually applied; the result is a large expense to pay for the skilled labor.

The beauty of tile makes it a desirable feature in homes as well as commercial buildings. However, with the increasing cost of labor, the beautiful tile walls we have seen in the past may well become an economic impossibility in newly erected structures.

It is not only the cost of manual labor, but also the period of time in which the mastic must set which makes the laying of tile a time consuming operation. The inherent delay in moving the workers of another craft into the work area following the setting of the grout detracts from the efficiency of the construction operation.

BRIEF DESCRIPTION OF THE INVENTION

To solve this problem it is herein suggested that setting tile can be accomplished in a much faster way by a two-step process. The first step involves the mounting of backing members on a wall or other substrate by means of (1) having the backing member mounted directly on the wall or (2) mounting the backing member on a strip of paper, fabric, film or the like which will serve as a means for mounting on the wall. The strip of material or the backing member itself will have an adhesive on one side; thereby, the strip of material may be applied to a wall surface as quickly and as easily as applying wall paper. With the backing members located in a predetermined design on the outer surface of the strip of material, the resulting tile decoration which will result can be predetermined.

The backing member is designed to receive the decorative facing tile in releasably locked condition and to hold the same in place in a manner to prevent relative rotation between the backing and tile members.

To accomplish this non-rotation feature, the backing member has a raised geometric shape or pattern in relief on its front surface and a hole through the middle. The back face of the tile member includes a recess which is the mirror image of the geometric raised shape on the front side of the backing member and further includes a prong projecting rearwardly from the back face of the tile itself. The prong includes an enlargement which is designed to penetrate the hole in the backing member during the mounting process; the surface of the hole then contracts behind the enlargement to releasably hold the tile against the backing member.

Objects of the invention will be clear from a review of the drawings and a reading of the detailed description of the preferred embodiment which follows:

BRIEF DESCRIPTION OF THE DRAWINGS

FIG. 3 is a sectional view of a tile mounted on a backing member taken along line 3—3 of FIG. 2;

FIG. 4 is a front elevational view of a strip of backing members;

FIG. 5 is a rear elevational view of the strip of FIG. 4;

FIG. 6 is a rear elevational view of the back face of a tile;

FIG. 7 is a sectional view of a backing member taken along line 7—7 of FIG. 4; and FIG. 8 is a sectional view of a tile member taken along line 8—8 of FIG. 6.

DESCRIPTION OF THE PREFERRED EMBODIMENT

This invention is concerned with a fast and inexpensive way of assembling tiles on a substrate such as a wall or perhaps a ceiling. It will be clear from the following description that the process and product could be used to cover the whole wall, a portion thereof or only a small geographic area. The latter is a possibility when one might wish to have this technique as a possibility for mounting a small pattern of tiles to form a picture or design.

Figure 1:
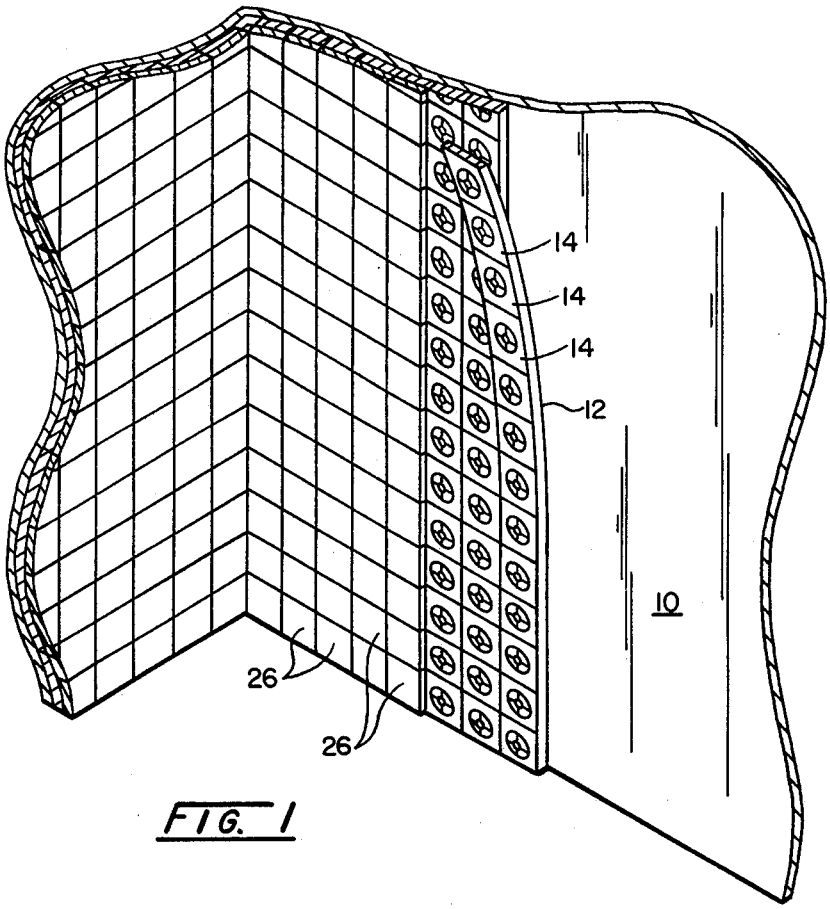
FIG. 1 is a perspective view of converging walls with tiles and backing members mounted thereon and being mounted thereon in accordance with this invention.
Figure 2:
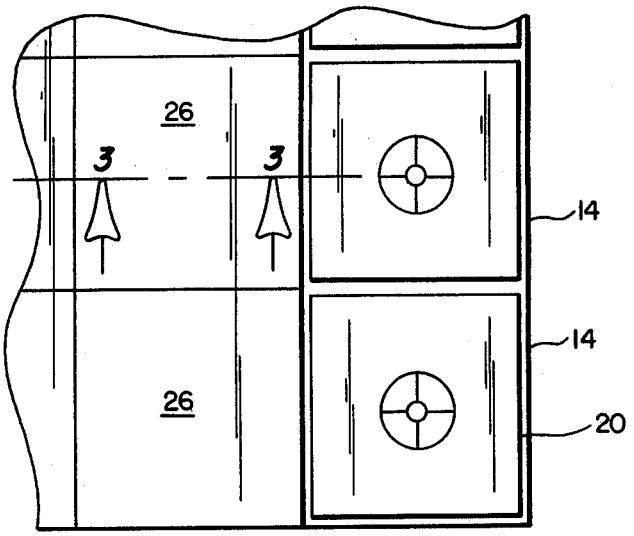
FIG. 2 is a front elevational view of a plurality of tiles mounted on a strip of backing members adjacent to a strip of backing members having no tiles mounted thereon.

FIG. 1 shows a substrate 10 having a strip of material 12 affixed thereto by an adhesive on its back surface. It is desired that backing members 14 be preassembled in a desired geometric pattern on the strip of material prior to the time it is mounted on the substrate. (Hereinafter, it will be considered that the backing members 14 are mounted on a strip of material 12 but the backing members could be manufactured in a strip or a rectangular sheet which could be attached to a wall by an adhesive applied to the wall without departing from the spirit of the invention.)

The backing member could be mounted on strip 12 by a machine in the manufacturing operation and the strip of material with the backing members adhered thereto could be transported as a roll or as a flat sheet of any desired width. As shown herein, each strip is as wide as one tile width but that is obviously for illustrative purposes only because there is no known limitation on the size of the strip of material 12.

The backing member itself is preferably made of conventional polymeric material readily available on the market. Further, it is made hollow where possible to minimize the cost of materials and the weight of the backing member itself which must be supported by the strip of material and the adhesive bonding the same to the substrate.

The back side 16 of the backing member is bonded to one side of the strip of material and the front side 18 includes a patterned relief 20 which in this case is shown as a raised rectangle. Its function will be explained subsequently.

In the center of the front side of the backing member is an opening 22 and as will be observed in FIG. 7, the material surrounding the opening 22 is very thin and for good reason. Radially extending slits 24 project outwardly from the hole to allow the thin plastic to flex inwardly and outwardly without breaking when an object greater in size than the hole 22 is pushed therethrough as will also be explained subsequently. The illustration of four slits 24 which forms four flaps 25 is arbitrary; there could be three, five or ten slits and the function would be the same.

A facing tile 26 is designed for mounting on the backing member and its front face 28 may be colored or patterned in any desirable fashion to present a pleasing appearance to an observer when the tile is assembled either alone or in combination with other tiles.

The back face 30 of tile 26 also has a patterned relief 32 which is specifically designed as the mirror image of the patterned relief 20 on the front side of the backing member 14. When the tile is properly assembled with the backing member the patterned relief of the backing member will nest with the patterned relief 32 of the tile and together they will prevent relative rotation of the tile with respect to the backing member. This is obviously desirable since orientation is extremely important in the esthetic appearance of tile walls or wall hangings. Because of the fact that the function of the patterned relief 20, 32 is to maintain the orientation of the two elements to be assembled, it will be clear that the geometric shape of the patterned relief can be any geometric shape except circular. A circular shape would allow the tile to rotate with respect to the backing member even though the patterned relief was in nested position, so long as the prong 34 was located in the geometric center of the patterned relief. Should the prong 34 be located any place but the geometric center of the patterned relief then the patterned relief could be circular and still the two elements 14 and 26 would not rotate one relative to the other. However, it will be seen in the drawings that the preferred design is a raised generally rectangular shape on the front portion of the backing member with the mating depression of a corresponding rectangular shape in the rear surface of the tile member 26.

It is intended that the mating portions of the patterned relief be relatively tight fitting because grouting between tiles should be unnecessary even though it is possible. With the intended mounting, if a facing tile become broken or defaced, it can be replaced by pulling it from its mounting and replacing it with a new one. Also, because of the potential for replacing tiles individually, the backing member must be solidly connected to the substrate to prevent separation when a tile is removed. Accordingly, the backing member may be nailed or screwed to the wall.

It will be observed that the prong 34 includes an enlargement 36 near its end which is larger than the opening 22. When the enlargement 36 is pushed through the opening 22 the slits will allow the flaps 25 to flex out of the way until the enlargement passes through the hole. Then the flaps will flip back into place to releasably lock the backing member and tile together, see particularly FIG. 3. At this point the patterned relief 20, 32 of the two elements will be in nested position and the combined heighth of the two will be about ½ inch from the substrate surface.

It will be observed that relative dimensions of the length of the prong 34, thickness of the enlargement 36, and the thickness of the flaps 25 are critical to the proper functioning of the tile mounting process. The flaps are relatively thin so that the prong 34 can penetrate the opening 22 and the flaps can spring back into place before the enlargement 36 encounters the surface of the strip of material 12 adhered to the substrate 10. Therefore the thickness of the enlargement measured perpendicular to the surface of the substrate 10 must be less than the thickness of the backing member 14 between the substrate 10 and the inner surface of flaps 25. Correspondingly, the length of the prong from the recessed back face of the tile 26 must be approximately equal to the height of the raised patterned relief 20 plus the thickness of the flaps 25. In that manner the mating patterned relief sections 20, 32 will be locked in position when the flaps spring back into normal position.

Having thus described the invention it will be clear that modifications could be made in the preferred embodiment without departing from the spirit of the invention. Accordingly, it is not intended that the words used to describe the invention be limiting thereon nor should the drawings be considered so. It is intended that the invention be limited only by the scope of the appended claims.

I claim:

1. In the combination of a tile and a backing member for mounting the tile on a substrate, the backing member including a front side and a planar back side, means for attaching the backing member to a substrate, means for forming an opening through the backing member, the means forming the opening being of thin resilient plastic having slits extending outwardly from said opening to thereby form not less than three flaps around said opening, said flaps being attached to said backing member and projecting therefrom to form said opening at a location spaced from said planar back side toward said front side, a single prong projecting along a straight line from the back face of the tile and having an enlarged portion which projects laterally from said line to form an outline measured perpendicular to said line which is larger in size than the opening in said backing member and said enlarged portion is of a thickness measured along said line which is less than the thickness between the flaps and the back side of the backing member, the prong being of a length and the enlarged portion being located thereon such that the enlarged portion will pass through said opening and the flaps will spring into place behind the enlarged position as the back face of the tile engages the front face of the backing member to releasably lock the tile and backing member together, and means forming a pattern of relief on the front side of the backing member, the back face of the tile member being configured to nest with the pattern in relief on the front side of the backing member whereby the patterns in relief will nest together when in register and prevent relative rotational movement.

2. The combination of claim 1 wherein the pattern in relief on the backing member is raised and generally rectangular in shape.

3. The combination of claim 2 wherein the prong projects from substantially the center of the back face of the tile.

4. The combination of claim 1 wherein the prong projects from substantially the center of the back face of the tile.

* * * * *